US007773368B2

(12) United States Patent
Borchardt et al.

(10) Patent No.: US 7,773,368 B2
(45) Date of Patent: Aug. 10, 2010

(54) INSTALLATION ADAPTER FOR A FUSE AND METHOD OF ADAPTING A FUSE FOR INSTALLATION

(75) Inventors: Glenn R. Borchardt, Round Lake Beach, IL (US); Michael G. Ennis, Evanston, IL (US); Jorge R. Montante, Cicero, IL (US); Martin A. Warszawa, Arlington Heights, IL (US)

(73) Assignee: S&C Electric Company, Chicago, IL (US)

( * ) Notice: Subject to any disclaimer, the term of this patent is extended or adjusted under 35 U.S.C. 154(b) by 230 days.

(21) Appl. No.: 11/784,654

(22) Filed: Apr. 9, 2007

(65) Prior Publication Data

US 2007/0259559 A1 Nov. 8, 2007

Related U.S. Application Data

(60) Provisional application No. 60/793,053, filed on Apr. 19, 2006.

(51) Int. Cl.
*H01H 85/20* (2006.01)

(52) U.S. Cl. ..... 361/626; 337/159; 337/187; 439/250; 439/366

(58) Field of Classification Search ..... 337/187, 337/159; 439/250, 366, 622, 620.26–620.34, 439/830, 890, 849, 850, 412; 361/626
See application file for complete search history.

(56) References Cited

U.S. PATENT DOCUMENTS 1,793,305 A * 2/1931 Cowles ..... 337/226
3,118,035 A * 1/1964 Lebens ..... 337/209
3,139,499 A * 6/1964 Cosgrove ..... 337/188
3,246,106 A * 4/1966 Alexis ..... 337/209
3,585,558 A * 6/1971 Swain ..... 337/226
3,588,775 A * 6/1971 Poehlman, Jr. ..... 337/226
3,744,003 A * 7/1973 Dipace ..... 439/638
3,829,810 A * 8/1974 Giegerich ..... 337/202
4,023,884 A * 5/1977 Morlan ..... 439/628
4,074,219 A * 2/1978 Nordberg et al. ..... 337/186
4,128,291 A * 12/1978 Peterson, Jr. ..... 439/786
4,448,476 A * 5/1984 Perlman et al. ..... 439/620.28
4,613,195 A * 9/1986 Suher et al. ..... 439/166
4,950,195 A * 8/1990 Perreault et al. ..... 439/830
5,085,600 A * 2/1992 Damron ..... 439/620.28
5,951,328 A * 9/1999 Roper, Jr. ..... 439/620.27
6,168,471 B1 * 1/2001 Santa Cruz et al. .... 439/620.29
6,483,417 B1 * 11/2002 Guthrie et al. ..... 337/188
6,720,857 B2 * 4/2004 Borchardt et al. ..... 337/244

* cited by examiner

*Primary Examiner*—Anatoly Vortman

(57) ABSTRACT

A fuse incorporates a fusible element assembly and an auxiliary fusible element assembly in a solid arc extinguishing material configuration. The fusible element assembly has a first operating characteristic and the auxiliary fusible element has a second operating characteristic different than the first operating characteristic. An installation adapter may be used to adapt a fuse to a non-standard mounting for the fuse. The installation adapter may include first and second adapter members that secure to the fuse to provide contacts having an appropriate spatial relationship to engage the non-standard mounting. A fuse and an installation adapter may be packaged as a kit.

10 Claims, 3 Drawing Sheets

INSTALLATION ADAPTER FOR A FUSE AND METHOD OF ADAPTING A FUSE FOR INSTALLATION

This application claims the benefit of U.S. Provisional Application No. 60/793,053 filed Apr. 19, 2006.

TECHNICAL FIELD

This patent relates to fuses used in electrical power distribution systems and more particularly to a fuse, an installation adapter for a fuse, a method of adapting a fuse for installation in a non-standard mounting for the fuse and a kit for adapting a fuse for installation in a non-standard mounting for the fuse.

BACKGROUND

Power distribution system operators use a variety of devices to protect system infrastructure from damage resulting from a fault occurring in the power distribution system. A commonly used fault protection device is a fuse. A fuse includes a fusible element that responsive to a fault condition, i.e., a current in excess of a threshold value for a predetermined period of time, opens the current carrying circuit to isolate equipment on one side of the fuse from the fault on the other side of the fuse. The fusible element is typically a conductor that responsive to the fault current melts or otherwise separates to open the circuit.

Power distribution system equipment is designed, manufactured and installed to have a long service life. Fuses used to protect system components engage the system in a mount that electrically couples the fuse into the power distribution system between a source and a load. The fuse mount is specified and has electrical contacts that engage electrical contacts, e.g., ferrules, of the fuse. Typically, the mount is specified for a particular fuse type to be used in the system. As fuse designs become obsolete and new fuse technology is introduced, it may become desirable to use a different fuse type in the system. Doing so generally requires the system operator to replace the fuse mounts to accommodate the new fuse type. Such replacement may involve costs and environmental concerns that exceed the advantages of using the new fuse type. However, such replacement may become inevitable if the originally specified fuse type is made obsolete and is no longer commercially available.

DETAILED DESCRIPTION

An installation adapter couples to a fuse to permit the fuse to be installed in a non-standard mount for the fuse. A fuse and corresponding mount, e.g., a standard mount for the fuse are mutually designed such that fuse is easily installed into the mount and removed from the mount for replacement. Typically, electrical contacts of the fuse, e.g., ferrules, engage electrical contacts of the mount with the engagement of the ferrules with the electrical contacts securing the fuse in the mount. The electrical contacts of the mount are sized and spaced to correspond to the size and spacing of the ferrules. Thus, a fuse of one type may not be easily installed in a mount for which it is not designed, e.g., a non-standard mount for the fuse.

In accordance with one of the herein described embodiments, an adapter may be fitted to the fuse to allow the fuse to be fitted to a non-standard mount, i.e., a mount for which the fuse was not designed to engage. The adapter may include a first adapter member that secures to one of the fuse ferrules and a second adapter that secures to the other of the fuse ferrules. The adapters include electrical contacts that are either spaced at a predetermined distance to fit the non-standard mount or that may be adjustable to allow the fuse fitted with the adapter members to couple to the non-standard mount. Alternatively, providing at least one of the electrical contacts of the fuse has a configuration permitting it to couple to a corresponding contact of the mount, the installation adapter may include a single adapter member, which may or may not include an adjustment feature.

A kit may be produce that includes a fuse having a predetermined configuration, an installation adapter and instructions for configuring the fuse using the installation adapter to fit a non-standard mount. The installation adapter may contain one or more adapter members. A corresponding method utilizes an installation adapter to provide for configuring a fuse to be compatible with a non-standard mount.

A fuse may be adapted in accordance with the described embodiments to have dual operating characteristics, e.g., a slow operating, low fault current characteristic and a fast operating, high fault current characteristic.

Figure 1:
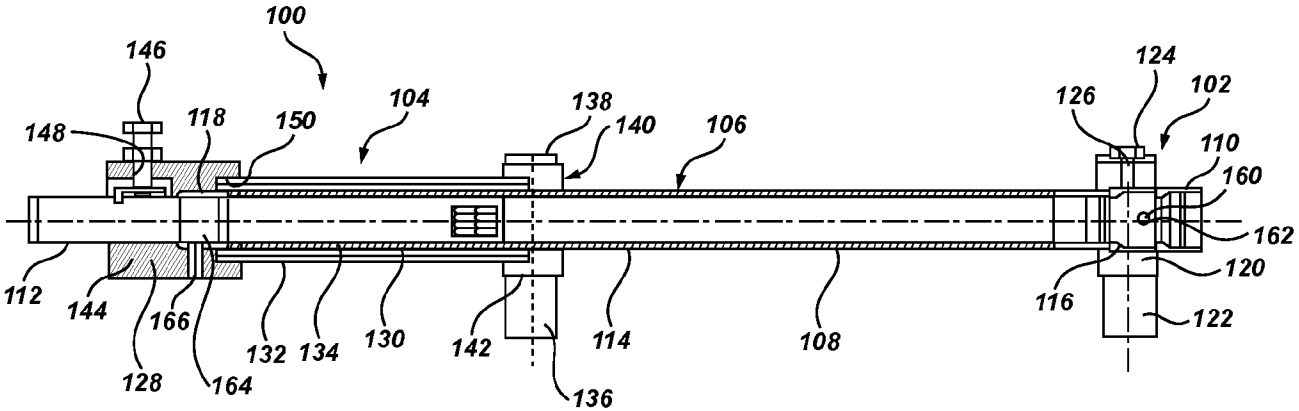
FIG. 1 is a side view of a fuse including an installation adapter, the installation adapter being shown in cross-section.

Referring to FIG. 1 an installation adapter 100 including a first adapter member 102 and a second adapter member 104 is fitted to a fuse 106. The fuse 106 may include a housing 108 having a first end 110, a second end 112 and an outer surface 114. The housing 108 has a predetermined length separating the first end 110 from the second end 112. The housing furthermore has a predetermined diameter (although other than round configurations may be envisioned). The first end 110 includes a first coupling ferrule 116 and the second end 112 includes a second coupling ferrule 118 that allows the fuse 106 to be coupled to a mount (not depicted) configured for the fuse 106, e.g., a standard mount for the fuse 106. That is, the first and second coupling ferrules 116 and 118 are sized and spaced to engage contacts of a standard mounting for the fuse.

The installation adapter 100 may include the first adapter member 102, if necessary. The first adapter member 102 may not be necessary if the first end 110 and the ferrule 116 may suitably engage a contact of the non-standard mounting (not depicted) to which the fuse is being adapted for installation. If necessary, the first adapter member may include a generally annular member 120 that may be received about a portion of the first end 110 and a portion of the first coupling ferrule 116 and to electrically couple to the first coupling ferrule 116. The first adapter member may further have an electrical contact 122 to engage a first contact of the non-standard mounting. The fastener, such as a set screw or securing bolt 124 engages a threaded aperture 126 formed in the annular member 120 and engages against either or both of the fuse housing 108 at the first end 110 and the ferrule 116.

The installation adapter 100 may also include the second adapter member 104. The second adapter member 104 may have a generally annular member 128 that is received about a portion of the second end 112 and a portion of the second coupling ferrule 118. The member 128 electrically couples to the second coupling ferrule 118. The second adapter member 104 may further have a sleeve portion 130 that extends along the outer surface 114 of the housing 108 from the second end 112 and member 128 toward the first end 110. The sleeve portion 130 may include an insulating surface 132 and a conductive layer 134. A second electrical contact 136 may be formed at an end 138 of the sleeve portion 130. The conductive layer 134 electrically couples the member 128 engaging the ferrule 118 with the electrical contact 136. The electrical contact 136 may be formed as part of an end assembly 140 formed at the end 138. The end assembly 140 may include an insulating annular portion 142 and a conductor (not depicted) that couples to the contact 136.

In an embodiment illustrated in FIG. 1, the member 128 may include an annular collar 144. The collar 144 is received about the portion of the second end 112 and the portion of the second ferrule 118. The collar 144 may include a fastener 146, such as a set screw or securing bolt, which is received within a threaded aperture 148 for securing the collar 144 to the second end 112. The collar 144 further includes a bore 150 within which the sleeve 130 is received such that when the collar 144 is secured to the second end 112, the conductive layer 132 is electrically coupled to the ferrule 118. An optional conducting member (not depicted) may be provided as part of the collar 144 that couples the ferrule 118 to the conductive layer 132.

Figure 2:
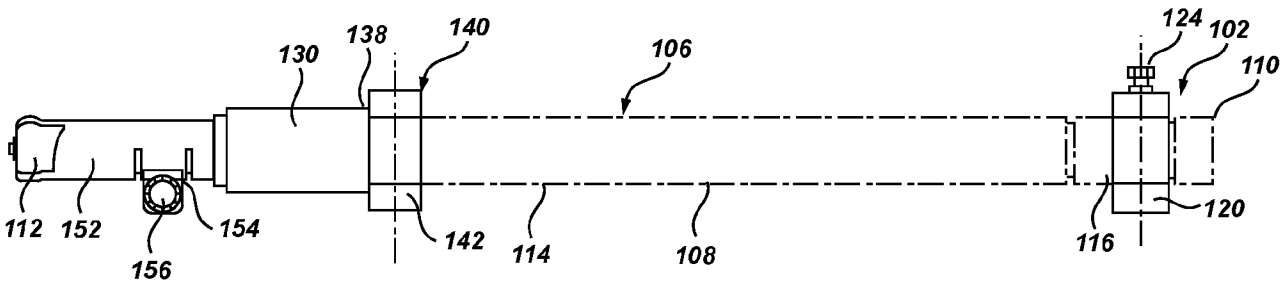
FIG. 2 is a side view of a fuse including an installation adapter according to another embodiment.

In an alternative embodiment illustrated in FIG. 2, the member 128 may include an annular collar 152. The collar 152 is received about the portion of the second end 112 and the portion of the second ferrule 118. The collar 152 may include a clamp member 154 formed integral therewith and a fastener 156, such as a securing bolt, that is received within a threaded aperture (not depicted) for securing the collar 152 and hence the sleeve 130 to the second end 112. The collar 152 may be received within a bore (not depicted) formed in the sleeve 130 such that when the collar 152 is secured to the second end 112, the conductive layer 132 engages the ferrule 118.

The first adapter member 102 and the second adapter member 104 allow contacts 120 and 136 to be positioned to the fuse 106 in appropriate spaced relationship to engage the contacts of the intended non-standard mounting for which the fuse is being adapted. That is, the contact 120 is positioned by the first adapter member 102 substantially adjacent the ferrule 116. The contact 136 is positioned relative to the contact 120 based upon the dimensions, e.g., length, of the sleeve 130. Both the first adapter member 102 and the second adapter member 104 positively engage the first end 110 and the second end 112 of the fuse 106, respectively, to ensure the distance relationship is maintained. Additionally, alignment features may be provided within the first adapter member 102 and the second adapter member 104. Such alignment features may engage corresponding alignment features formed on the fuse first end 110, second end 112, ferrule 116, ferrule 118 or any suitable part of the fuse. For example, as shown in FIG. 1, the ferrule 116 may include a dimple 160 that is engaged by a spring loaded ball or similar structure 162 formed in the first adapter member 102. Alternatively, and as shown for example also in FIG. 1, the ferrule 118 is formed with a slot 164 engaged by a spring loaded ball or similar structure 166. Various other alignment features formed on each of the adapter members 102/104 and the fuse 106 may be used, such as, without limitation: a dimple, a slot, a tab, a notch, a flat, a spline or a combination thereof. The alignment features may secure the position of the contacts 120 and 136 lengthwise as well as prevent rotation of the contacts 120 and 136 relative to the fuse 106.

As shown in each of FIGS. 1 and 2, the sleeve 130 extends along the housing 108 of the fuse 106 such that the distance between the contact 120 and the contract 136 is less than a distance between the ferrule 110 and the ferrule 112. It will be appreciated that for certain applications the sleeve 130 may extend away from the first end 110 effectively providing a spacing between the contacts 120 and 136 that is longer than the spacing between the ferrules 110 and 112. Furthermore, the contacts 120 and 136 are shown aligned along the housing 108 of the fuse 106. The contacts need not be so aligned, and in certain applications the contacts 120 and 136 be rotated about the housing 108, e.g., at 90° or 180° of each other. The adapter members 102 and 104 may also provide a radial offset relative to the housing 108, i.e., one or both contacts may be radially displaced from a centerline of the fuse 106 by unequal distances. It will be appreciated that the adapter members 102 and 104 may take on various configurations to provide for contact positioning to allow the fuse to be fitted to the non-standard mounting. Also, while the assembly 140 and contact 136 are shown fixed relative to the sleeve 130, the assembly 140 may be made adjustable along the sleeve 130. In this manner, the distance between the contact 120 and 136 may be field settable. For example, the assembly 140 may have an annular collar configuration slidable along the sleeve 130 with a suitable fastener to secure it to the sleeve 130 at the desired location. The fastener or another portion of the assembly 140 may be made to engage the conductive layer 132 to provide electrical conductivity between the contact 136 and the ferrule 118.

Figure 3:
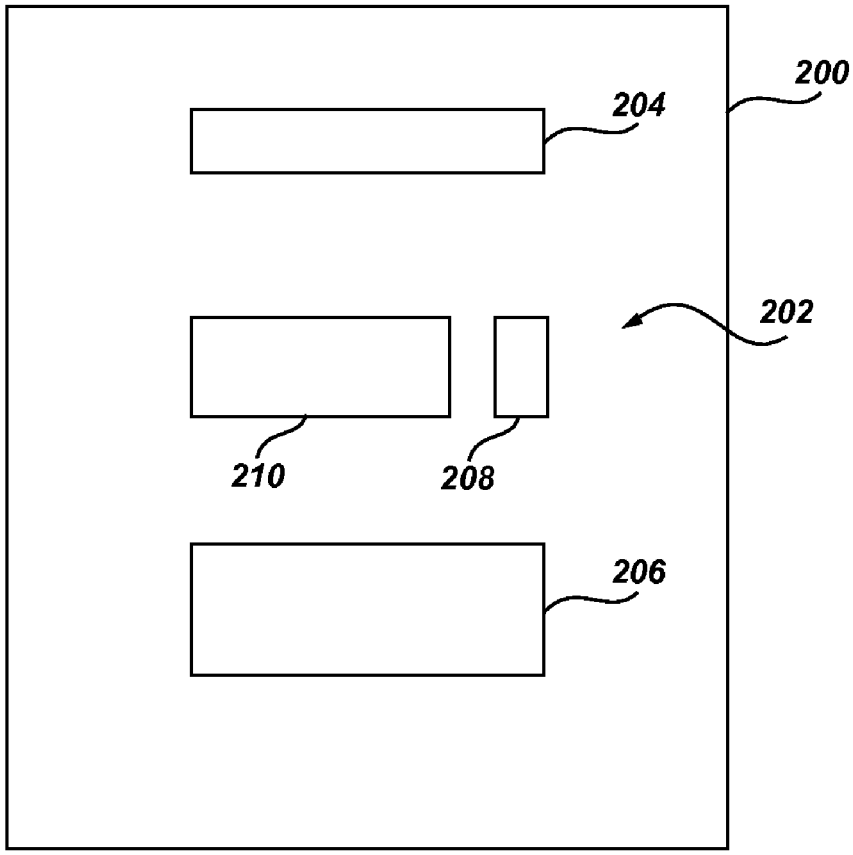
FIG. 3 is a schematic illustration of an installation adapter kit.

With reference to FIG. 3, for the convenience of the installer, a kit 200 may include an installation adapter 202 packaged together with a fuse 204 and use instructions 206. The installation adapter 202 may configured as described above for the installation adapter 100 and thus it may include first and second adapter members 208 and 210, although in certain applications only one of the two adapter members may be required. The installation instructions inform the installer how to properly adapt the fuse 204 using the installation adapter 202 for use in a non-standard mounting, and may further contain various instructional guidance and cautions.

Figure 4:
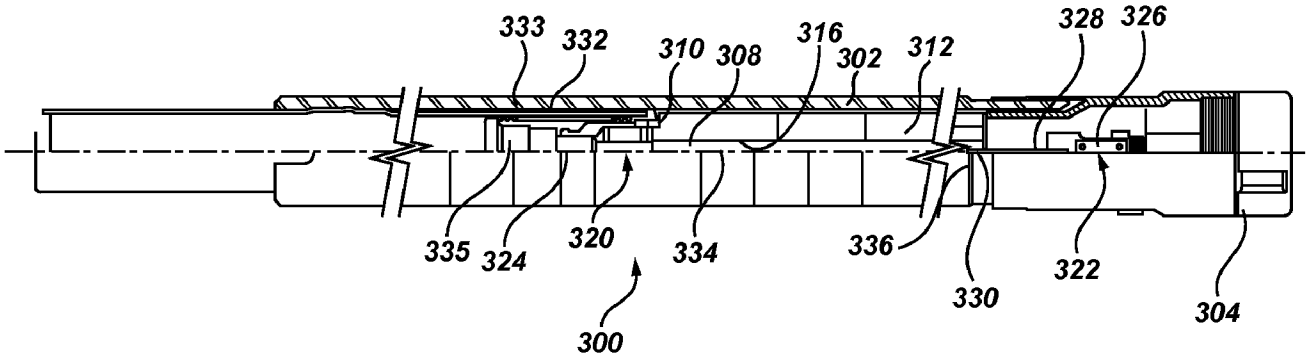
FIG. 4 is a partial cross-section view of fuse including fusible element and an auxiliary fusible element.

An installation adapter as described herein may permit a fuse to be installed in a mounting for a different fuse. That different fuse may have differing operational characteristics than the fuse to be adapted to fit the mounting. FIG. 4 illustrates a fuse 300 that may two distinct operating characteristics. For example, the fuse 300 may have both a slow acting, low fault current operating characteristic and a fast acting, high fault current characteristic. The fuse 300 may further incorporate solid arc extinguishing material. In this regard, the fuse 300 may be suitable for use replacing liquid power fuses used in combination with fault current limiting resistors.

The fuse 300 may include a housing 302 that has a length extending from a first end 304 to a second end 306 and an interior space 308 having an interior surface 310. An arc extinguishing material 312, such as a solid arc extinguishing material like boric acid or any suitable arc extinguishing material, may be disposed on the interior surface 310 for at least a portion of the length. A passageway 316 is formed in the arc extinguishing material 312 and extends within the arc extinguishing material longitudinally with respect to the housing 302. A fuse assembly 320 is disposed within the housing 302 and may have a portion extending through the passageway 316. The fuse assembly 320 may include a fusible element assembly 322 and an arcing rod assembly 324 coupled to the fusible element assembly 322.

The fusible element assembly 322 may have a fuse element 326 of having a first fault clearing rating coupled to link assembly 328 including a releasable attachment member 330. The fusible element assembly 322 is secured within the interior space 310 adjacent the first end 304.

Figure 5:
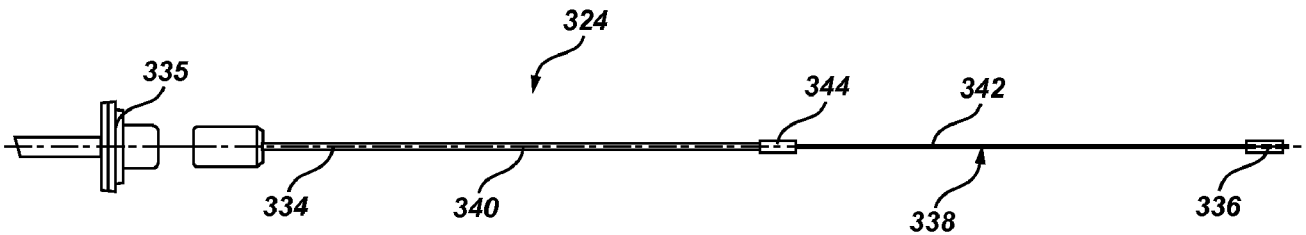
FIG. 5 is a partial view of an arcing rod assembly that may be used in the fuse shown in FIG. 4.

The arcing rod assembly 324 (FIG. 5) may include a drive mechanism 332 including a drive spring 333 coupled to a head structure 335 of an elongate arc rod 334. The arc rod 334 may include a coupling member 336 that releasable secures to the attachment member 330. The arc rod 334 may further include an auxiliary fuse element 338 having a second fault clearing rating that is different than the first fault clearing rating. The arcing rod assembly 324 is secured within the interior space 310 between the first end 304 and the second end 306. The arc rod assembly 324 includes a portion that extends through the passageway 316, and the coupling member 336 is releasably coupled to the releasable attachment member 330. For example, the releasable attachment member 330 may be a hook and the coupling member 336 may be a loop sized to engage the hook. The drive mechanism 332 is configured to impart a driving force via the spring 333 and head assembly 335 on the arcing rod assembly 324 to move the arcing rod assembly 324 within the housing 302 toward the second end 306 during operation of the fuse.

The arcing rod assembly 324 may include a first wire portion 340 and a second wire portion 342, the second wire portion forming at least a portion of the auxiliary fuse element 338. The first wire portion 340 and the second wire portion 342 may be coupled by a mechanical compression fastener 344 or another suitable fastener such that they are mechanically and electrically coupled. Each of the first wire portion 340 and the second wire portion 342 may be lengths of a suitable conductive, fusible wire. For example, each of the first wire portion and the second wire portion may be lengths of nichrome wire (copper wire or silver wire). The diameter of the second wire portion 342 may be made smaller in the range of about 0.5 mm to about 1.0 mm than the diameter of the first wire portion 340 in the range of about 1.2 mm to about 3.0 mm such that when exposed to the a fault current, the second wire portion 342 melts in a controlled manner, while the first wire portion 340 remains substantially intact.

As indicated, the fuse 300 may have dual operating characteristics. The dual operating characteristics may be provided by configuring the fuse element 326 with a first operating characteristic. For example, the fuse element 326 may have a low current, slow acting fault protection characteristic in the range of about 1 ampere to about 50 amperes operating in about 30 milliseconds to about 1 second. The auxiliary fuse element 338 may have a second operating characteristic that is different than the first operating characteristic. For example, the auxiliary fuse element 338 may respond quickly to high current faults such as in the range of 50 amperes to about 500 amperes in about 10 milliseconds to about 30 milliseconds.

Upon action of either the fuse element 326 or the auxiliary fuse element 338 in response to a fault current, for example, the melting of the fuse element 326 or the second wire portion 342, the arcing rod assembly 324 is separated from the fusible element assembly 322. The drive mechanism 332 drives the arcing rod assembly toward the second end 304, and hence draws the first and second wire portions 340 and 342 through the passageway 316. A resulting arc is extended within the passageway 316 and is extinguished by the arc extinguishing material 312. Under higher magnitude fault conditions, e.g. 50-500 amperes, auxiliary fuse element 326 melts almost instantaneously and because of its long length the elongation of the arc is greatly accelerated and thus allows the current to be extinguished much more quickly. The second wire portion may be made to have a diameter of about 0.5 mm to about 1.0 mm. Correspondingly, the passageway diameter may be about 3.0 mm to about 5.0 mm.

While the present disclosure is susceptible to various modifications and alternative forms, certain embodiments are shown by way of example in the drawings and the herein described embodiments. It will be understood, however, that this disclosure is not intended to limit the invention to the particular forms described, but to the contrary, the invention is intended to cover all modifications, alternatives, and equivalents defined by the appended claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Unless a claim element is defined by reciting the word "means" and a function without the recital of any structure, it is not intended that the scope of any claim element be interpreted based on the application of 35 U.S.C. §112, sixth paragraph.

The invention claimed is:

1. An installation adapter for installing a fuse in a non-standard mounting for the fuse, the fuse including a housing having a first end, a second end and an outer surface, the first end including a first coupling ferrule and the second end including a second coupling ferrule, the first and second coupling ferrules sized and configured to engage a standard mounting for the fuse, the adapter comprising:

a first adapter member, the first adapter member to be received about a portion of the first end and a portion of the first coupling ferrule and to electrically couple to the first coupling ferrule, the first adapter member further having a first electrical contact to engage a first contact of the non-standard mounting;

a second adapter member, the second adapter member having a first portion to be received about a portion of the second end and a portion of the second coupling ferrule and to electrically couple to the second coupling ferrule, the second adapter member having an electrically conducting sleeve portion extending from the first portion, the sleeve portion having an end and a second electrical contact formed at the end to engage a second contact of the non-standard mounting; and wherein the second electrical contact is adjustably moveable and securable along the sleeve member for setting a distance between the first electrical contact and the second electrical contact.

2. The installation adapter of claim 1, the sleeve portion configured to extend over a further portion of the second end and along the housing toward the first end, the sleeve portion end configured to disposed about the housing outer surface.

3. The installation adapter of claim 1, the first and second adapter members comprising fasteners, respectively, for securing the first and second adapter members to the fuse to be adapted.

4. The installation adapter of claim 1, the first and second adapter members comprising a first alignment feature and a second alignment feature, respectively, for engaging a first contact ferrule alignment feature and a second contact ferrule alignment feature of the fuse to be adapted, engagement of the first alignment feature and the second alignment features with the first contact ferrule alignment feature and the second contact ferrule alignment feature causing the installation adapter to be aligned to the fuse to be adapted.

5. The installation adapter of claim 4, engagement of the first alignment feature and the second alignment feature with the first contact ferrule alignment feature and the second contact ferrule alignment feature preventing rotation of the first adapter member and the second adapter member with respect to the fuse to be adapted, respectively.

6. The installation adapter of claim 1, wherein the first alignment feature and the second alignment feature comprises a dimple, a slot, a tab, notch, a flat, a spline or a combination thereof.

7. A method of adapting a fuse for installation in a non-standard mounting for the fuse, the fuse having a housing having a first end, a second end and an outer surface, the first end including a first coupling ferrule and the second end including a second coupling ferrule, the first and second coupling ferrules sized and configured to engage a standard mounting for the fuse, the method comprising:

securing a first adapter member about a portion of the first end and a portion of the first coupling ferrule such that a first electrical contact of the first adapter member is electrically coupled to the first coupling ferrule and the first electrical contact is positioned with respect to the fuse to engage a first contact of the non-standard mounting;

securing a second adapter member to the fuse such that a first portion is received about a portion of the second end and a portion of the second coupling ferrule and is electrically coupled to the second coupling ferrule and an electrically conducting sleeve portion of the second adapter member extends from the first portion such that an end of the second adapter member and a second electrical contact formed at the end is position relative to the first electrical contact to engage a second contact of the non-standard mounting when the first electrical contact is engaged with the first contact of the non-standard mounting; and adjustably moving the second electrical contact along the sleeve member to set a distance between the first electrical contact and the second electrical contact, and securing the second electrical contact at the set distance.

8. The method of claim 7, comprising extending the sleeve portion over a further portion of the second end and along the housing outer surface toward the first end.

9. The method of claim 7 wherein securing the first and second adapter members to the fuse comprises using fasteners.

10. The method of 7, comprising engaging a first alignment feature and a second alignment feature, respectively, with a first contact ferrule alignment feature and a second contact ferrule alignment feature of the fuse to align the installation adapter to the fuse.

* * * * *